United States Patent [19]

Reschenhofer et al.

[11] Patent Number: 4,497,478

[45] Date of Patent: Feb. 5, 1985

[54] APPARATUS FOR SQUARING, STAPLING, AND STACKING COPY SETS

[75] Inventors: Rudolf Reschenhofer; Ludwig Müllritter, both of Munich; Günther Schnall, Eching; Franz Fruth, Germering, all of Fed. Rep. of Germany

[73] Assignee: Agfa-Gevaert AG, Leverkusen, Fed. Rep. of Germany

[21] Appl. No.: 533,578

[22] Filed: Sep. 19, 1983

[30] Foreign Application Priority Data

Sep. 20, 1982 [DE] Fed. Rep. of Germany ..... 3234746

[51] Int. Cl.[3] ..... B42B 1/02

[52] U.S. Cl. ..... 270/53; 227/7; 355/3 SH

[58] Field of Search ..... 270/53, 58; 227/2–7, 227/209; 355/3 SH, 14

[56] References Cited

U.S. PATENT DOCUMENTS

| | | | |
|---|---|---|---|
| 3,685,712 | 8/1972 | Turner et al. | 227/7 X |
| 4,134,672 | 1/1979 | Burlew et al. | 227/7 X |
| 4,168,059 | 9/1979 | Potoczek | 355/3 SH |
| 4,235,431 | 11/1980 | Abrams et al. | 355/3 SH |
| 4,270,742 | 6/1981 | Kobayashi | 270/53 |
| 4,318,555 | 3/1982 | Adamski | 227/7 |
| 4,460,269 | 7/1984 | Yamazaki et al. | 355/3 SH X |

*Primary Examiner*—E. H. Eickholt

*Attorney, Agent, or Firm*—Michael J. Striker

[57] ABSTRACT

An apparatus for squaring, stapling, and stacking copies is used in combination with a copier that produces a succession of sheet copies and has a housing adapted to be positioned adjacent the copier, an upper support plate in the housing positioned to receive the copies from the copier and having a downstream end remote from the copier, and a stop flap at the downstream end and pivotal between a position blocking copies from sliding down off the downstream end and a freeing position permitting copies to slide down off the downstream end. A downwardly inclined lower support plate in the housing below the downstream end of the upper plate is positioned to receive copies sliding in the freeing position of the stop flap off the downstream end of the upper plate. A stapler is fixed in the housing adjacent the upper plate upstream of the downstream end thereof and an actuator is connected to the stapler for closing same on a stack of copies on the upper plate for stapling same together. A controller is connected to the stop flap and the stapler actuator for periodically stapling the copies on the upper plate together and thereafter pivoting the stop into the freeing position to slide the stapled-together copies onto the lower plate.

20 Claims, 8 Drawing Figures

APPARATUS FOR SQUARING, STAPLING, AND STACKING COPY SETS

FIELD OF THE INVENTION

The present invention relates to an apparatus that receives copies from a conveyor of a copier machine, squares them in groups, staples them together, and stacks them. More particularly this invention concerns such an apparatus which works with a collating copier.

BACKGROUND OF THE INVENTION

A copier of the type described in German patent document 2,733,521 filed by H. Kishi et al with a claim to a Japanese priority date of July 12, 1976 can make a plurality of sets of copies from a multipage master. The machine scans each page of the master repeatedly, producing a number of copies of each page equal to the desired number of copy sets wanted. The machine has a group of collating bins each of which receives a respective copy set from a conveyor mechanism which drops one copy of a given page into one bin, then drops the next copy of the same page into the following bin, and so on.

This type of machine provides at its output individual copies of a single master, usually delivering them at the end of the run in a sequence starting with the first page of the first set of copies, and ending with the last page of the last set of copies, so that one copy set immediately follows another. The individual copy sets are offset by a movable plate or table from each other.

Stapling together the copy sets cannot be done without first squaring them, that is aligning the pages of each copy set with the overlying or underlying set. In addition it is fairly common for the copy sets to get mixed up with each other, that is for one set to actually include some copies from another set.

OBJECTS OF THE INVENTION

It is therefore an object of the present invention to provide an improved copy-sorting apparatus.

Another object is the provision of such a copy-sorting apparatus which overcomes the above-given disadvantages, that is which produces a squared and neat stack of stapled copy sets without mixing copies from one set with those of another.

SUMMARY OF THE INVENTION

An apparatus according to this invention is used in combination with a copier that produces a succession of sheet copies and has a housing adapted to be positioned adjacent the copier, an upper support plate in the housing positioned to receive the copies from the copier and having a downstream end remote from the copier, and a stop flap at the downstream end and pivotal between a position blocking copies from sliding down off the downstream end and a freeing position permitting copies to slide down off the downstream end. A downwardly inclined lower support plate in the housing below the downstream end of the upper plate is positioned to receive copies sliding in the freeing position of the stop flap off the downstream end of the upper plate. A stapler is fixed in the housing adjacent the upper plate upstream of the downstream end thereof and an actuator is connected to the stapler for closing same on a stack of copies on the upper plate for stapling same together. A controller is connected to the stop flap and the stapler actuator for periodically stapling the copies on the upper plate together and thereafter pivoting the stop into the freeing position to slide the stapled-together copies onto the lower plate.

The copier according to this invention has a controller coupled to the control means of the apparatus. Thus operation of the two machines is synchronized. The upper plate is downwardly inclined from the copier.

The stapler of this invention is of the standard desk type, having an anvil-carrying lower part sitting on the housing and an upper arm pivotal relative thereto and carrying a supply of staples. Thus this part can be replaced relatively easily, and itself can be of well-known construction.

Means is provided according to this invention for compressing an edge of the copier stack at the stapler before stapling this edge together. This compression is effected slowly and gently, so as not to shift the copies relative to each other and to allow the relatively violent stapling action to take place without any shifting. This means can be the pivotal upper arm of the stapler. The actuator therefor includes a solenoid connected thereto. In addition the actuator or compressing means includes a cam coupled to the arm. This cam has one cam formation coupled to the arm and another formation coupled to the stop flap so the cam forms part of the control means.

This control means in turn tincludes a switch at least indirectly operated by the cam. It can also have various photocell arrangements for detecting proper positioning and size of the copy stack, and indicators for showing any malfunction, as well as circuitry connected to the copier controller.

The solenoid of this invention has an armature suspended from and pulling down the arm and the cam is provided with a pin engageable upward underneath the arm opposite the armature. Thus the weight of the solenoid serves to compress the stack edge. Further means is provided for arresting the pin when the stapler is not in place in the housing at the edge of the stack. To this end the pin is formed with a groove and the means for arresting includes a spring engageable in the groove and an abutment for displacing the spring out of the groove when the stapler is in place in the housing at the edge of the stack. Two leaf springs engaged between pins in the stapler base can work in this manner, with one of the pins being displaceable when the stapler is in position to spread the springs and free the pin.

The actuating and compressing means can also include a rotary wheel and a link connected eccentrically to the wheel and to the arm for first displacing the arm down and then forcing a staple therefrom through the stack. This wheel is centered on and rotatable about an axis and works toggle-fashion, that is it has a central point when the link, its pivot on the wheel, and the wheel axis are aligned so that the velocity curve of the stapler arm is sinusoidal. In such a system the link is vertically coupled to the arm, that is they cannot move vertically relative to each other.

Spring means urges the stop flap into the blocking position. This spring means can work through a lever coupled to position-detecting switches as described above.

In accordance with another feature of this invention squaring means is provided for aligning the copies with one another perpendicular to their transport direction when engaged against the stop flap. Such squaring means includes a disk extending parallel to the copy transport direction and engageable transversely with the copies. This disk is rotatable about and displaceable along an axle extending across underneath the upper plate.

DESCRIPTION OF THE DRAWING

The above and other features and advantages will become more readily apparent from the following, reference being made to the accompanying drawing in which.

SPECIFIC DESCRIPTION

Figure 1:
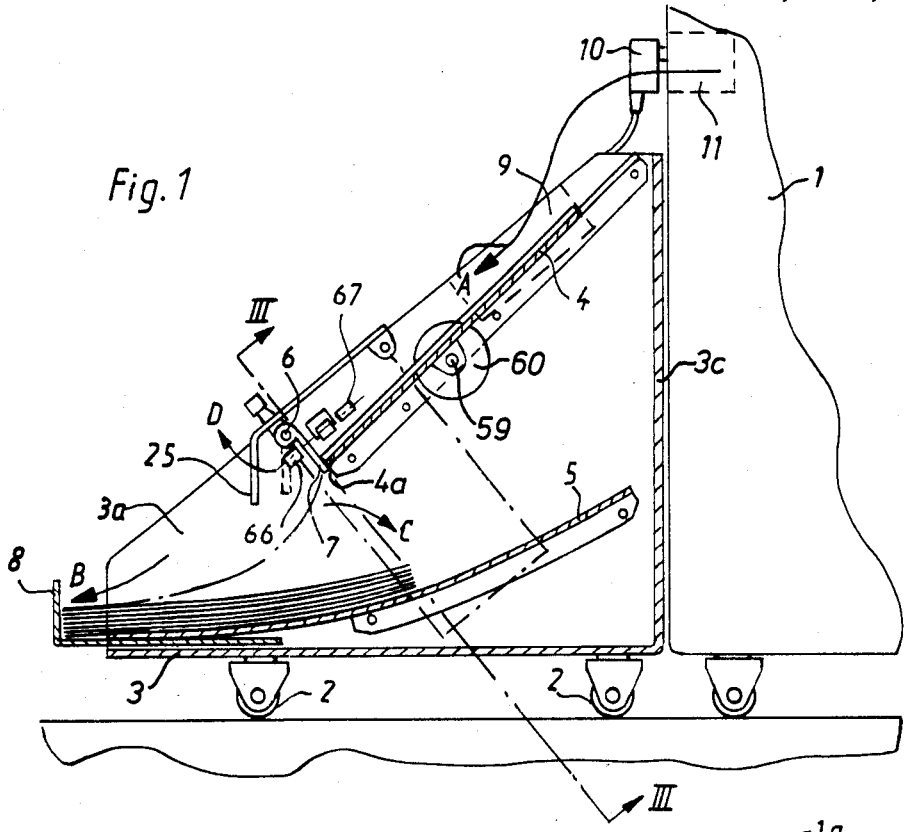
FIG. 1 is a vertical and longitudinal section through the apparatus according to this invention.
Figure 2:
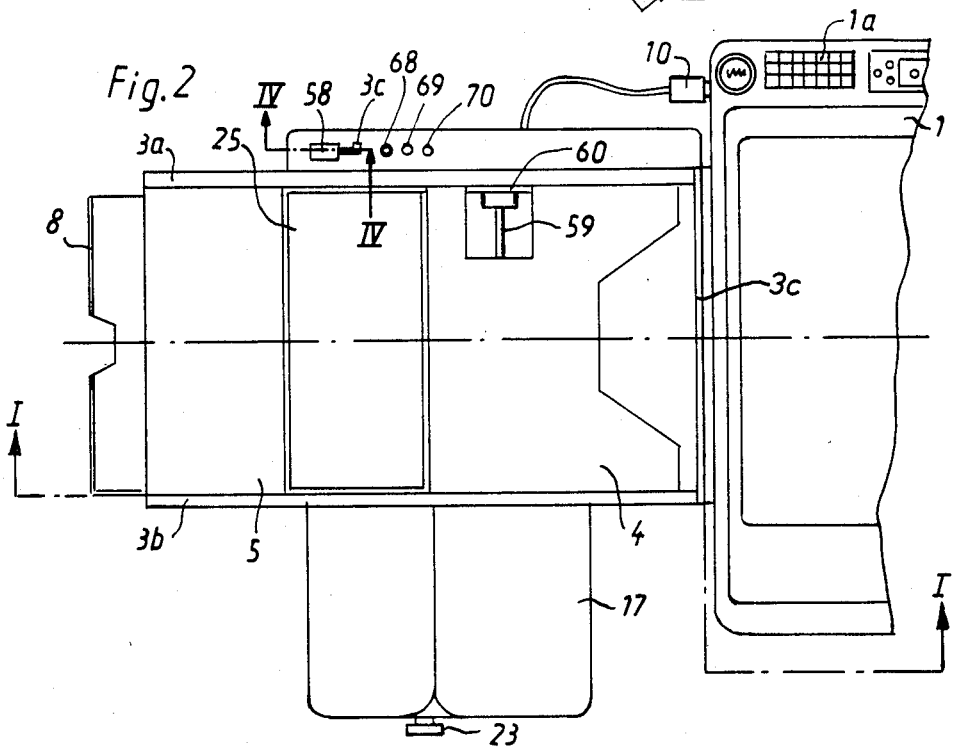
FIG. 2 is a top view of the structure shown in FIG. 1, line I—I of FIG. 2 representing the section plane of FIG. 1.

As seen in FIGS. 1 and 2 a copying machine 1 having a control panel 1*a* and a controller 11 is associated with a stapling and stacking machine according to this invention which has a housing 3 supported on rollers 2 and having a pair of vertical and longitudinally extending side walls 3*a* and 3*b* and a vertical and transverse upstream end wall 3*c* that normally lies immediately adjacent the copier 1. A plug 10 of the machine of this invention connects its electronic controller 9 to the controller 11 and power supply of the copier 1.

An upper support plate 4 and a lower plate 5 are suspended between the side plates 3*a* and 3*b* and are both inclined down away from the copier 1. The upper plate 4 is planar and has a downstream end 41 juxtaposed with a stop flap 7 carried on a transverse pivot 6 journaled in the plates 3*a* and 3*b*. This flap 7 can move between a solid-line blocking position in which it abuts the lower downstream end 4*a* of the plate 4, and a dashed-line open position in which it is spaced and angled back from this lower end 4*a*.

Normally copies or copy sets are delivered from the copier 1 sequentially in the direction indicated by arrow A. They therefore slide down along this plate 4 so that their leading edges come to rest in aligned position against the stop 7. A squaring disk 60 (FIG. 3) described below can square the stack 40 thus formed and a stapler 12 (FIG. 3 also) can staple together the left-hand edge of the stack 40 when the requisite number of copies have been stacked up.

Once stapled, the stack 40 is released by pivoting of the flap 7 in direction D into the freeing position so the stack 40 slides down in direction B, being deflected by a cover plate 25 and coming to rest against an adjustable stop 8 at the downstream end of the plate 5. The rear ends of the copies flop back as indicated by arrow C, so that the stapled stacks 40 form a neatly squared pile with their leading edges aligned.

Figure 3:
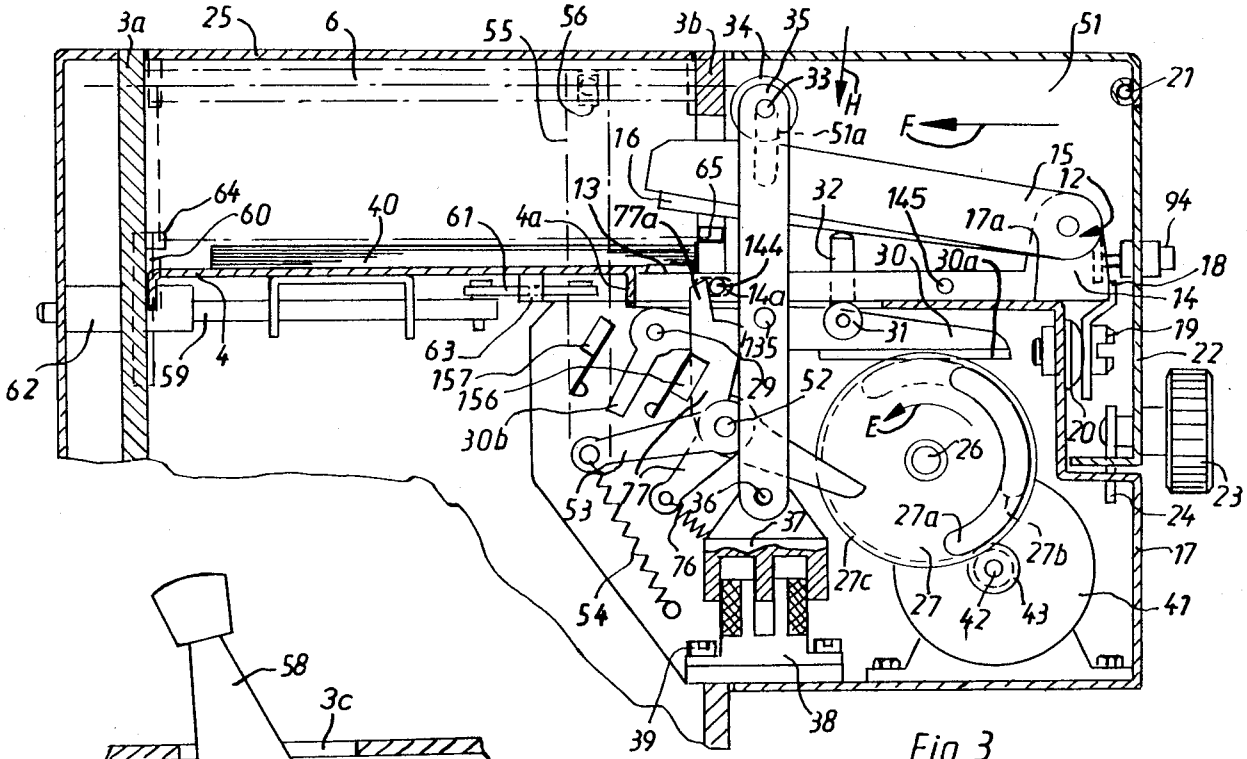
FIG. 3 is a large-scale transverse section taken along line III—III of FIG. 1.

As best seen in FIG. 2 the apparatus housing plate 3*b* has a secondary transversely projecting support housing 17 having as seen in FIG. 3 end plates 51 and forming an internal support surface 17*a* parallel to the plate 4 but slightly below the plane of its upper surface. This secondary housing 17 has a cover plate or door 22 pivoted about an axis 21 to allow access to the region above the surface 17*a*. A knob 23 with a locking pawl 24 can secure the cover 22 tightly closed on the housing 17.

FIG. 3 shows a standard desk-type stapler 12 having a lower part 14 carrying an anvil 13 and a pivoted upper part or arm 15 provided with a standard openable staple magazine 16. This stapler 12 is secured on the surface 17*a* extending transversely from the stack 40 on the plate 4 and is positioned to staple through the squared left-hand edge of the stack 40. It is secured on the surface 17*a* by sliding it in the direction F through the open door 22 until the leading end of the lower part 14 abuts a turned-down edge 4*a* of the plate 4. A clip 18 carried on a screw 19 and held in place thereon by a spring 20 is then pivoted into place behind the lower part 14 to lock the stapler 12 in place.

When the door 22 is open it is normally possible to replace the staples in the magazine 16 without removing the stapler 12 from inside the housing extension 17. In fact the staple slot can be closed by an element 94 on the door 22 that not only automatically opens and closes the rear end of the channel where a new stick of staples is inserted in the direction F into the back of the stapler arm 15, but also indicates how many staples are left in the magazine 16.

The upper staple arm 15 and magazine 16 sit on an upright pin 32 vertically displaceable in the lower staple part and bearing downward on a roller 31 in the middle of a third-class lever or arm 30 having an inner end pivoted at 29 on the plates 20 and an outer end formed with a turned-forward edge 30*a*. A cam disk 27 is pivoted about a longitudinal axis 26 in the two end plates of the housing 17 and carries a front cam 27*a* and a rear cam 27*b*, the latter being engageable with the edge 30*a*. An electric motor 41 contained in the housing has an output shaft 42 carrying a pinion 43 meshing with teeth on the cam disk 27.

Figure 6:
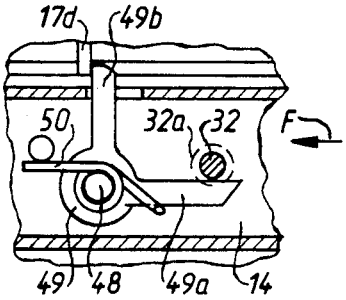
FIG. 6 is a top view of the structure shown in FIG. 5.
Figure 5:
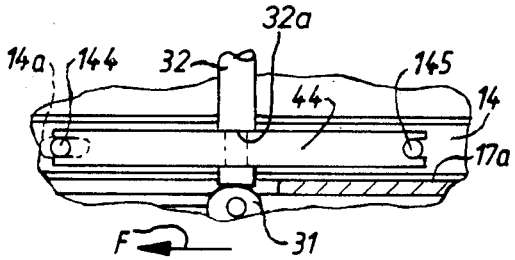
FIG. 5 is a large-scale transverse and vertical section through a detail of the apparatus of this invention.

The pin 32 that transmits force from the cam 21*b* to the arm 15 is normally freely vertically displaceable in the lower part 14 and can extend down through the surface 17*a*. In order to allow the stapler to be removed, it is formed with a radially open groove 32*a* shown in FIGS. 5 and 6 and in which can engage two leaf springs 44 and 45. A rod 145 fixed in the base 14 is formed with grooves 144*a* receiving the forked rear ends of these springs 44 and 45, and another rod 144 extends through slots 14*a* in the base 14. The outer ends of the rod 144 are engageable with stops 17*d* formed on centering rails 17*b* extending up from the surface 17*a*. Thus when the stapler is pushed into place in the direction F, the rod 144 will be pushed toward the rod 145, thereby spreading the springs 44 and displacing them out of the groove 32*a*. The machine is driven so that it only stops in the open or up position of the arm 15 and so that as the stapler 12 is pulled out against the direction F, the springs 44 and 45 will engage in the notch 32*a* and lock the pin 32 in place.

Figure 7:
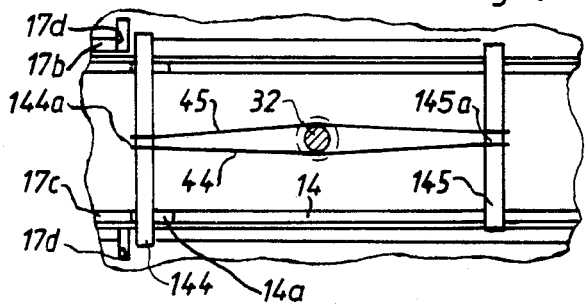
FIG. 7 is a large-scale transverse and vertical section through a variation on the detail of FIG. 5.

It is also possible as shown in FIG. 7 to provide the stapler base 14 with a two-arm lever 49 pivoted about a vertical axis 48 parallel to the pin and having one arm 49*a* engageable in the groove 32*a* and another arm 49*b* projecting from the side of the base 14. A torsion spring 50 urges the arm 49*a* into engagement with the pin 32, but the other arm 49*b* is engageable with the abutment 17*d* to pivot it out of the groove 32*a*. Thus the pin 32 can only move vertically when the stapler 12 is out of the machine.

An upright link 35 carries at its upper end a longitudinal pivot 33 that rides in uprright slots in the plates 51 and that carries a roller 34 engaging the top of the stapler arm 15. The lower end of this link 35 is pivoted at 36 on the armature 37 of a solenoid 38 secured by bolts 39 to the housing 17. This solenoid 38 can exert considerable force to drive a staple through the stack 40.

The link 35 has a longitudinally projecting pin 135 under which a lever 77 pivoted at 52 in the plates 51 can engage. This lever 77 is urged counterclockwise, that is out of the path of the in 135, by a tension spring 76, and has a nose 77*a* that is engageable by the outer end of the front pin 144. Thus as the stapler 12 is pushed into position in the machine, its pin 144 pushes the lever 77 back and frees the link 35 for vertical reciprocation as described below.

In addition the lever 30 has another arm 30*b* that can actuate either of two position-detecting switches 156 and 157 that are both connected to the controller and that respectively control the motor 41 and the electromagnet 38. More particularly, the motor 41 can only stop when the arm 30*a* is in its uppermost position, in which the arm 30*b* engages and operates the switch 156. The electromagnet 38 is only energized, on the contrary, when the lever 30 is all the way down and the arm 30*b* is actuating the switch 157. Thus the machine will only be able to stop with the stapler in the open position, and the electromagnet 38 will only drive a staple when the stapler is all the way down, after precompressing the stack.

In use the cam 27 rotates in the direction E and holds the pin 32 and arm 15 up in the illustrated position while the set of copies is being delivered to and squared up on the plate 4. Once the stack 40 is complete, as signaled to the controller 9 from the controller 11, the cam 27*b* moves past the edge 30*a* and allows the arm 15 to drop down, pulled by the considerable weight of the armature 37. This action gently but firmly compresses the stack 40 at the stapling location, using a force large enough to flatten the stack out without causing the pages to misalign.

Figure 4:
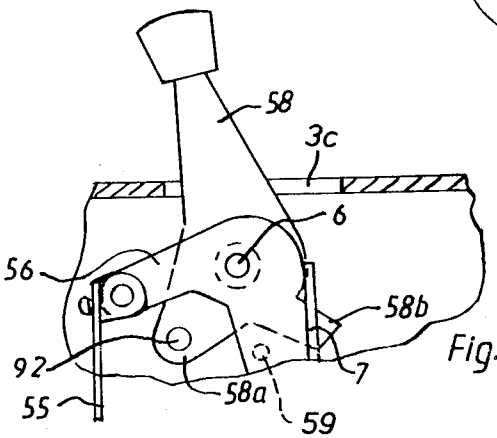
FIG. 4 is a large-scale section taken along line IV—IV of FIG. 2.

The front cam formation 27*a* acts on an arm of a two-arm lever 53 pivoted at 52, like the pawl 77, and urged counterclockwise also by a respective tension spring 54. A link 55 connected to the other arm of this lever 53 is connected to an arm 56 carried by the stop flap 7, as also shown in FIG. 4. This cam 27*a* only serves to raise the link 5 and flip the stop 7 into the open position when the stapling operation is complete. Obviously, such action drops the stapled stack down onto the lower support 6.

When the copies are not to be stapled together in sets, it is possible to override the automatic storage and stapling by means of a lever 58 shown in FIGS. 2 and 4. This lever 58 is carried on the shaft 6 of the stop 7 and projects through an L-shaped slot 3*c* in the housing. It has an arm 58*a* carrying a pin 92 that can engage under and lift the arm 56, thereby holding the stop 7 in the open position, and another arm 58*b* which works on a switch like the switches 156 and 157 that open-circuits the motor 41. Thus the copies will simply slide along the plate 5 and move directly, without stopping, to the plate 6. The lever can be pivoted counterclockwise as seen in FIG. 4 into the feed-through position at any time.

In order to square the stack 40 before stapling it together, the apparatus is provided with a circular squaring disk 60 lying in a vertical plane parallel to the direction A and perpendicular to the plate 4. This disk 60 is carried on a shaft 59 journaled in the plate 4 and is reciprocated by a crank drive 61 operated by an unillustrated motor. An abutment 62 is provided to ensure proper squaring of the stack in the manner described in commonly owned U.S. patent application of Alfred Heider et al.

A microswitch 63 underneath the plate 4 can detect whether any copies are on it, and a photocell arrangement 64, 65 can detect when the stack 40 is too tall. In addition appropriate switches are provided to detect when the supply of staples in the magazine 16 is used up, and lamps 68, 69, and 70 (FIG. 2) indicate the various malfunctions, which also are normally signaled to the copier controller 11 to shut down the copier too.

Figure 8:
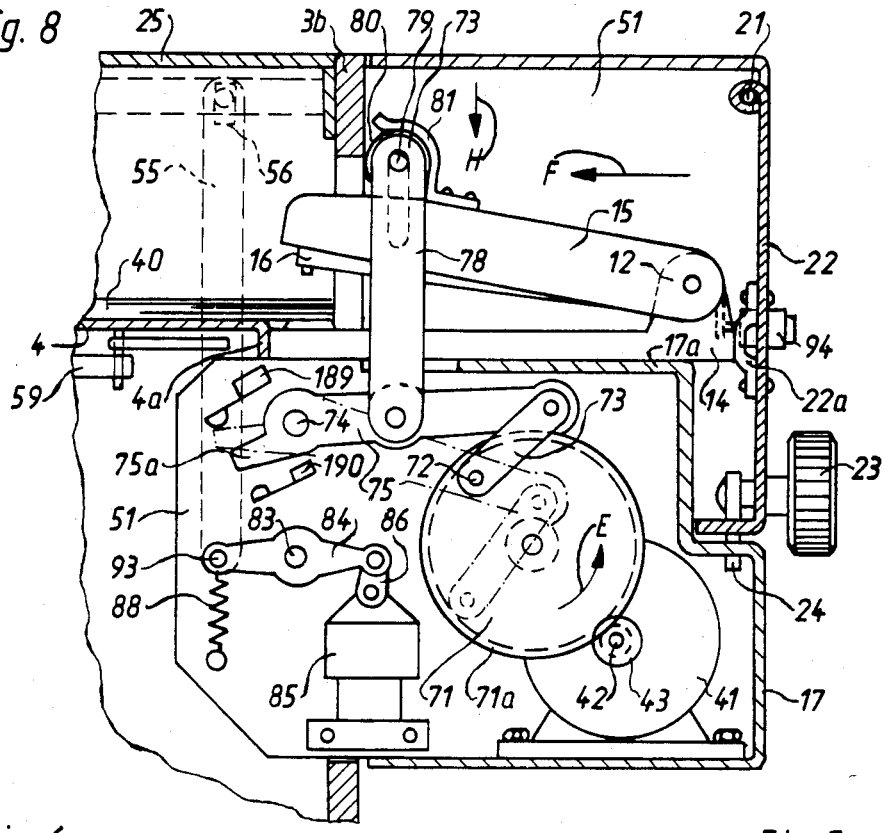
FIG. 8 is a longitudinal and vertical section corresponding to the righ-hand portion of FIG. 3, but of a variation on the apparatus of the instant invention.

FIG. 8 shows an arrangement that does the same job as that described above, but with a different mechanism, using of course the same references as FIG. 1 for identical structure.

Here the pinion 43 of the motor 41 meshes with teeth 71*a* of a crank disk 71 connected at an eccentric pivot 72 to a rigid link 73 pivoted at the outer end of a lever 75 whose other end is pivoted at 74 in the end plates 51. A rigid link 78 substantially identical to the link 35 is pivoted centrally on the lever 75 and carries at its upper end a shaft 79 carrying a pusher roller 80. A bow-shaped clip 81 is fixed to the top part 15 of the stapler 12 to couple it for joint vertical movement with the roller 80, eliminating the need for the biasing pin 32 of FIG. 1.

In this arrangement the relative positions of the various pivots interconnecting the structure described immediately above work toggle-fashion to multiply force considerable so that the motor 41, even though only capable of exerting relatively low torque, can effect the stapling operation. Thus as the disk 71 rotates in the direction E it first pulls the stapler arm 15 down relatively rapidly. As, however, the link 27 moves into a position crossing the axis of the wheel 71, the vertical displacement slows considerably, and in fact stops when a perfectly diametral position is obtained, with concomitant force multiplication. Thus the small drive motor 41 is able to create enough force to drive a staple through the stack 40.

In this arrangement the stapler 12 is secured against the edge 41 by a stop 22*a* provided on the cover 22. Simply closing this cover 22 therefore locks the stapler 12 in place, and opening it frees it for removal.

The flap 7 is here controlled by a solenoid 85 having a link 86 connected to one end of a two-arm lever 84 pivoted at 83 in the plates 51 and having an opposite end 93 connected on one side to a tension spring 88 and on the other to the link 55. An arm 75*a* of the lever 75 can operate a switch 189 at the end of the stapling operation to energize this solenoid 85 and open the flap 7, and an opposite switch 190 is connected to the motor 41 so it can only stop when the stapler 12 is in the illustrated up position.

With the system of this invention it is therefore possible to staple together stacks of copies whether the copies arrive one-by-one, as is usual, or in groups. The stacks are automatically squared and stapled, then dropped in a neat square stack. The machine is a valuable addition to a copier when multiple copies of a multipage document must be made.

We claim:

1. In combination with a copier that produces a succession of sheet copies, an apparatus comprising:

a housing adapted to be positioned adjacent the copier;

an upper support plate in the housing positioned to receive the copies from the copier and having a downstream end remote from the copier;

a stop flap at the downstream end and pivotal between a position blocking copies from sliding down off the downstream end and a freeing position permitting copies to slide down off the downstream end;

a downwardly inclined lower support plate in the housing below the downstream end of the upper plate and positioned to receive copies sliding in the freeing position of the stop flap off the downstream end of the upper plate;

means including a stapler fixed in the housing adjacent the upper plate upstream of the downstream end thereof;

actuating means connected to the stapler for closing same on a stack of copies on the upper plate for stapling same together; and control means connected to the stop flap and the stapler actuating means for periodically stapling the copies on the upper plate together and thereafter pivoting the stop into the freeing position to slide the stapled-together copies onto the lower plate.

2. The apparatus defined in claim 1 wherein the copier has a controller coupled to the control means of the apparatus.

3. The apparatus defined in claim 1 wherein the upper plate is downwardly inclined from the copier.

4. The apparatus defined in claim 1 wherein the stapler has an anvil-carrying lower part sitting on the housing and an upper arm pivotal relative thereto and carrying a supply of staples.

5. The apparatus defined in claim 4 wherein the stapler is a standard desk-type stapler.

6. The apparatus defined in claim 1, further comprising means for compressing an edge of the copier stack at the stapler before stapling this edge together.

7. The apparatus defined in claim 6 wherein the stapler has a pivotal upper arm forming the means for compressing.

8. The apparatus defined in claim 6 wherein the actuating means includes a solenoid connected thereto.

9. The apparatus defined in claim 6 wherein the actuating means includes a cam coupled to the arm.

10. The apparatus defined in claim 9 wherein the cam has one cam formation coupled to the arm and another formation coupled to the stop flap, the cam forming part of the control means.

11. The apparatus defined in claim 10 wherein the control means includes a switch at least indirectly operated by the cam.

12. The apparatus defined in claim 11 wherein the solenoid has an armature suspended from and pulling down the arm and the cam is provided with a pin engageable upwardly underneath the arm opposite to the armature.

13. The apparatus defined in claim 12, further comprising means for arresting the pin when the stapler is not in place in the housing at the edge of the stack.

14. The apparatus defined in claim 13 wherein the pin is formed with a groove and the means for arresting includes a spring engageable in the groove and an abutment for displacing the spring out of the groove when the stapler is in place in the housing at the edge of the stack.

15. The apparatus defined in claim 6 wherein the actuating and compressing means includes a rotary wheel and a link connected eccentrically to the wheel and to the arm for first displacing the arm down and then forcing a staple therefrom through the stack.

16. The apparatus defined in claim 15 wherein the wheel is centered on and rotatable about an axis and works toggle-fashion.

17. The apparatus defined in claim 11 wherein the link is vertically coupled to the arm.

18. The apparatus defined in claim 1, further comprising spring means for urging the stop flap into the blocking position.

19. The apparatus defined in claim 1, further comprising squaring means for aligning the copies with one another perpendicular to their transport direction when engaged against the stop flap.

20. The apparatus defined in claim 19 wherein the squaring means includes a disk extending parallel to the copy transport direction and engageable transversely with the copies.

* * * * *